United States Patent [19]

Klinger

[11] Patent Number: 4,574,936

[45] Date of Patent: Mar. 11, 1986

[54] COIN ACCEPTER/REJECTOR INCLUDING SYMMETRICAL DUAL FEEDBACK OSCILLATOR

[75] Inventor: Lance Klinger, 141 Del Medio Ave., Apt. 133, Mountain View, Calif. 94040

[73] Assignee: Lance Klinger, Mountain View, Calif.

[21] Appl. No.: 493,322

[22] Filed: May 10, 1983

[51] Int. Cl.[4] ..... G07F 3/02

[52] U.S. Cl. ..... 194/318

[58] Field of Search ..... 194/99, 100 R, 100 A

[56] References Cited

U.S. PATENT DOCUMENTS

| | | | |
|---|---|---|---|
| 3,059,749 | 10/1962 | Zinke . | |
| 3,317,016 | 5/1967 | Turillon . | |
| 3,401,780 | 9/1968 | Jullien-Davin . | |
| 3,576,244 | 4/1971 | Ptacek et al. . | |
| 3,599,771 | 8/1971 | Hinterstocker | 194/100 A |
| 3,741,363 | 6/1973 | Hinterstocker | 194/100 R |
| 3,749,220 | 7/1973 | Tabiichi et al. | 194/100 A |
| 3,901,368 | 8/1975 | Klinger | 194/100 A |
| 3,952,851 | 4/1976 | Fougere et al. | 194/100 A |
| 3,966,034 | 6/1976 | Heiman et al. | 194/100 A |
| 4,105,105 | 8/1978 | Braum | 194/100 A |
| 4,108,296 | 8/1978 | Hayashi et al. | 194/99 |
| 4,124,111 | 11/1978 | Hayashi | 194/102 |
| 4,128,158 | 12/1978 | Dautremont | 194/100 A |
| 4,226,323 | 10/1980 | Dautremont | 194/100 A |
| 4,234,071 | 11/1980 | Le-Hong | 194/100 A |
| 4,286,704 | 9/1981 | Wood | 194/100 A |
| 4,353,453 | 10/1982 | Partin et al. | 194/100 A |
| 4,371,073 | 2/1983 | Dubey | 194/102 |
| 4,398,626 | 8/1983 | Barnes | 194/100 A |
| 4,437,558 | 3/1984 | Nicholson et al. | 194/97 R |
| 4,441,602 | 4/1984 | Ostroski et al. | 194/100 A |
| 4,448,297 | 5/1984 | Mendelsohn | 194/100 A |

*Primary Examiner*—F. J. Bartuska

*Attorney, Agent, or Firm*—Ralf H. Siegemund

[57] ABSTRACT

In a coin operated machine, the coins are tested by utilizing a symmetric, dual feedback oscillator, each having a tank circuit with a reactance, one of the reactances being a reference reactance and the other one a sensing reactance being passed by a coin to be tested. Separate outputs are derived from symmetrical points in the oscillator and are compared in some form either through phase detection or by detecting the sum of the oscillating signals or by detecting the common mode and/or the differential mode of the envelopes or a combination of several of these tests whereby common mode and differential mode detection of the envelopes together is preferred. The reference reactance includes preferably a coin exactly of the type to be tested. Multi-coin variance and digital processing is additionally disclosed.

32 Claims, 7 Drawing Figures

TANK VOLTAGES
+V
TEST COIN CENTERED
TEST COIN TANK AMPLITUDE
35a
DIFFERENTIAL MODE VOLTAGE
COMMON MODE REF.
REF. COIN TANK AMPLITUDE
34a
(a)
0V
TEST COIN POSITION
COMMON MODE VOLTAGE-REFERENCE
(b)
55a
56a
DIFFERENTIAL MODE VOLTAGE
(c)
52a
0V
51a

COIN ACCEPTER/REJECTOR INCLUDING SYMMETRICAL DUAL FEEDBACK OSCILLATOR

BACKGROUND OF THE INVENTION

1. Field of the Invention

The present invention generally relates to coin detecting, discriminating and testing devices, and is more particularly directed to apparatus for testing a coin for the purpose of accepting or rejecting the same in a coinoperated vending machine, game, telephone or the like.

2. State of the Prior Art

Coin-operated equipment or machines are usually equipped with a device which tests any coin inserted therein. Various devices have been used in the past which embody some type of mechanical or electronic testing apparatus for discriminating against foreign coins or slugs.

Numerous types of devices are known and have been used in the past for such purposes. Exemplary of the state of the art is applicant's U.S. Pat. No. 3,901,368, the patents referred to therein and a number of subsequent patents. U.S. Pat. No. 4,234,071 issued to Le-Hong also discloses a device for checking metal pieces and particularly coins. It uses the technique of U.S. Pat. No. 3,901,368 with additional means for testing a coin in predetermined position as the coin passes.

Applicant's prior patent discloses a coin acceptor/rejector comprising a reference oscillator tuned to a fixed predetermined frequency and a current output stage driven by the reference oscillator and having a sensing tank circuit head adapted to resonate at or near the oscillator frequency when the desired coin is inserted in the vicinity of the inductor of the sensing tank, the latter inductor being mounted in the path of the coin within the coin operated device. The voltage developed across the tank circuit is measured and compared to a reference voltage derived from the common voltage supply to obtain a narrow amplitude detection band within which the tested coin is accepted. If the amplitude of the oscillations in the sensing tank circuit either exceeds or falls short of the detection band limits, the coin is rejected.

For optimal performance of the circuit it is critical to maintain the width of this amplitude detection band as narrow as possible in order to positively discriminate against coins or slugs approximating the characteristics of the desired coins. This requirement in turn creates high stability requirements and the circuit must be made as nearly insensitive to parameter changes as is possible to avoid drift of the very narrowly defined voltage levels at which the coin will be accepted. This is accomplished both through symmetrical and balanced design of the circuit with low drift components as well as through careful construction and positioning of the oscillator coil and sensing coil of the amplifier tank circuit.

The technique disclosed in applicant's prior patent benefits from working across the resonance characteristic of the sensing tank circuit to increase selectivity and to yield large signal levels able to be directly discriminated with minimum components. The coin diameter, thickness, and permeability yield an effective sensing coil inductance, and the coin's resistivity contributes to the effective sensing tank circuit lossiness (or Q).

The combination of effective inductance and lossiness of the sensing tank circuit yields the signal amplitude to be tested. Since a single amplitude test is performed to accept the coin, a slug made of a different metal, having a different effective inductance and lossiness, could be tailored to result in the acceptable signal level. The following invention does not have this limitation.

DESCRIPTION OF THE INVENTION

It is an object of the present invention to provide a new and improved apparatus, device and circuit for the purpose of testing coins which exhibits a still higher degree of sensitivity.

In accordance with the preferred embodiment of the present invention, it is suggested to provide a symmetric, dual feedback oscillator establishing a symmetrical substantially balanced circuit wherein each oscillator includes a tank circuit, one of the tank circuits including a reference reactance and the other one including a sensing reactance. Preferably the reference reactance includes a coin being exactly of the same type of coin whose validity is to be tested. The two cross coupled oscillators have two outputs respectively constituting symmetrical points as far as signals are concerned and comparator circuitry is connected to these outputs in order to determine their relationship and in order to determine whether that relationship meets specific criteria. In the preferred form, the oscillation envelopes are detected at these two oscillator points and the envelopes are processed in the differential mode and/or in the algebraic summing or common mode whereby in the case a proper coin passes the sensing reactance either mode exhibits specific and unique excursions. It is in addition detected whether or not these excursions fall within particular detection bands which test is then used as a criterium in order to accept or reject such a coin. In the alternative the oscillator signals may be compared directly as to phase and/or their amplitudes may be summed. In the former case, a proper coin will result in a particular phase such as 180° out-of-phase when passing the sensing coin. The algebraic sum should in this case be zero or assume a particular amplitude value that can be tested against a reference.

From a different point of view, the oscillator outputs are connected to circuitry determining the relationship between the effective inductivities as in the two tank circuits produced when a coin passes the sensing reactance. Additionally or alternatively, the lossiness of the two tank circuits is tested through the two oscillator outputs whereby as a result of the cross coupling lossiness should exhibit a minimum of a predeterminable nature when a proper coin passes the sensing reactance. The signal as mentioned above and as derived from the two oscillators can be processed through analog circuitry using comparators suitably biased in order to establish the accept and reject bands. Alternatively, the signals can be sampled and processed digitally through a microprocessor.

BRIEF DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings, in which:

DETAILED DESCRIPTION OF THE INVENTION

Figure 1:
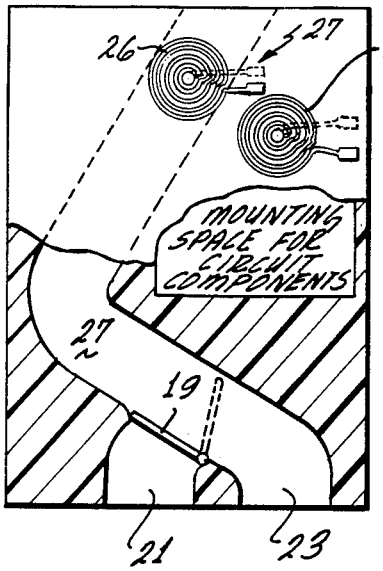
FIG. 1 illustrates the typical positioning of the sensor and reference inductors relative to the chute in a coin acceptor/rejector mechanism.

FIG. 1 illustrated in fragmentary view a typical coin-receiving mechanism in a coin-operated machine. A coin chute 27 is defined and dimensioned to accept the desired type of coin, which is inserted through an opening or slot located somewhere above the top end of the chute 27, so that the coin falls through the chute under the influence of gravity. The chute where it splits into paths 21 and 23, one of which is designed to accept the coin by directing it to a receptacle within the machine, the other path for rejecting the coin by returning it to a receptacle accessible from the exterior of the machine.

A mechanical gate 19 is movable by an electromechanical solenoid mechanism between an ACCEPT position such as shown in solid lines, and a reject position suggested in dotted lines, thus directing the coin between the two paths in response to the output of the discriminating circuit described below.

Figure 3:
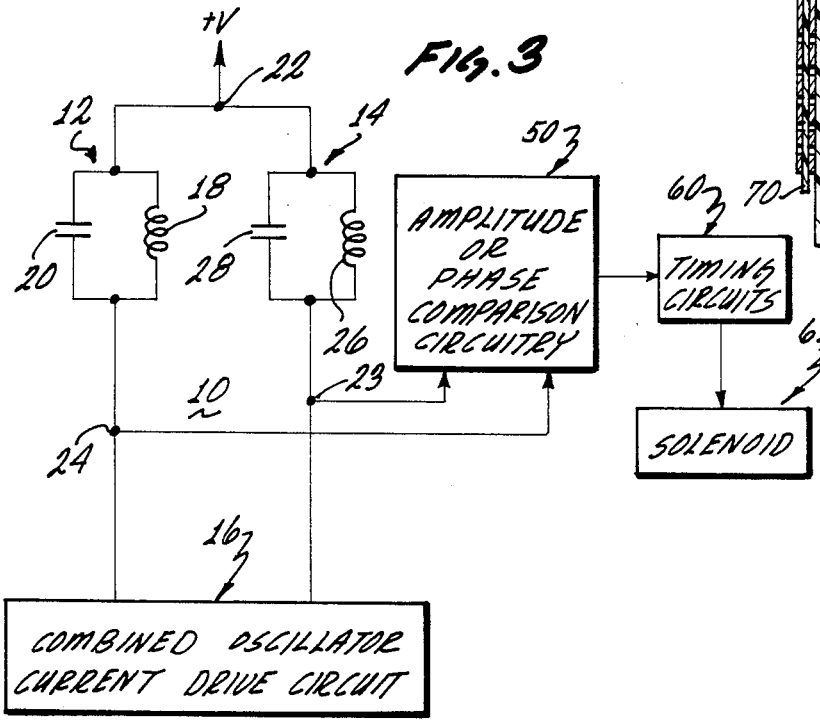
FIG. 3 is a block diagram representing an example of the generalized embodiment of the invention.

With reference to FIG. 3, the circuit of this invention comprises a first tank circuit 12 and a second tank circuit 14 as part of a symmetric, dual feedback oscillator circuit 16. The tank circuit 12 is arbitrarily designated as the reference circuit and consists of an inductor coil 18 in parallel with a capacitor 20 to form a parallel tuned circuit designed to resonate at a predetermined frequency. The tank circuit 12 is connected between a voltage supply node 22 and a reference or first test node 24. The second tank circuit 14 is the sensing circuit and comprises a sensing inductor coil 26 connected in parallel with a capacitor 28. The sensing tank circuit 14 is preferably designed to resonate at the same frequency as the reference tank circuit 12 when a desired coin is in immediate proximity to the sensing coil 26. The sensing tank is connected between the voltage supply node 22 and a sensing or second test node 23. The voltages at the reference and sensing nodes 24 and 23, respectively, constitute an input to a comparison circuit 50 which operates to derive an output indicative of the relative condition of the signals at the two nodes. It is possible to adjust or construct the comparison circuit to respond to various desired conditions at the test nodes, such as equality or inequality of voltage levels or a phase relationship greater or less than 180°. In the preferred configuration the difference and average (common mode) of nodes 23 and 24 envelope voltages will be established. The timing circuits and/or threshold circuits 60, which, in turn, are connected to operate solenoid-driven mechanisms 61, which physically accept or reject the coin in the coin-operated machine. It should be noted that the two capacitors 20 and 28 both have one end each connected to the V-plus line 22. In fact, it is possible to connect these two capacitors in series and to replace them by a single capacitor between nodes 23 and 24.

Figure 2:
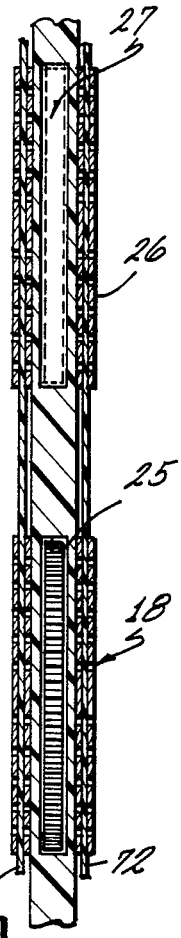
FIG. 2 is a cross section taken along line 2—2 of FIG. 1, showing the construction of the inductors and the use of a reference coin in the reference inductor.

A preferred physical construction of the reference inductor 18 and the sensing inductor 26 is best appreciated in FIGS. 1 and 2. As shown there, the two sets of coils 26 and 18 which are constructed in the shape of planar spirals and each of the inductors may comprise two or more such flat spirals in coaxial relationship. It is desirable, however, that the reference coil is centered on a line drawn through the sensing coil and perpendicular to the coin path to make coin entry and exit mutual induction symmetrical. A presently preferred mode of constructing the coils 18 and 26 may be appreciated from the cross section of FIG. 2, wherein two parallel circuit boards 70 and 72 are double clad with conductive material and etched to create four coaxial sprials for each of the inductors, the inductors being edge-to-edge and axial spaced from each other. The circuit boards 70, 72 are mounted within the vending or other coin operated machine such that the coin chute 27 passes between the circuit boards 70, 72 and is dimensioned such that the coins pass between the spaced spiral conductors of the sensing inductor 26. It will be appreciated that a metallic object passing through the inductor 26 in this manner will have the effect of decreasing the inductance of the sensing inductor which will cause resonance of tank circuit 14 to be at a higher frequency, assuming all other factors remain constant. It should be noted that with proper strain relief of electrical connections between coils on circuit boards 70 and 72, a hinged chute assembly could be constructed to enable opening to clear obstructions in the chute.

The reference inductor 18 is preferably constructed to be identical to the sensing inductor 26. The reference inductor 18, however, is provided with a reference coin 25 secured between the spaced coaxial coils of the reference inductor 18. In this manner, the reference reactance of tank circuit 12 is caused to have a resonant frequency substantially identical to the resonant frequency of the sensing tank circuit 14 at the moment when a coin nearly identical to the reference coin 25 drops through the chute 27, and is disposed in a particular relationship to the sensing inductor 26. At that particular moment, the oscillatory voltage signals at the two tank circuits will most nearly approach equal amplitudes due to the cross-coupled symmetric relationship of the oscillator current drive circuit 16. It is thus possible to detect the presence of a particular coin by measuring the characteristics of, and relationship between the oscillatory signals in the two tank circuits with a multiplicity of test criteria.

The split coil configuration for each tank circuit with spiral coil elements placed on both sides of the coin chute 27 and the placement of a reference coin 25 between split reference coils is preferred and is believed to establish optimum conditions for sensitivity and detection. However, different coil configurations could be used in principle. Also, a slug could be used in lieu of the reference coin but for reasons below, the regular coin identical in type, etc., to those to be accepted is clearly preferred.

Figure 4:
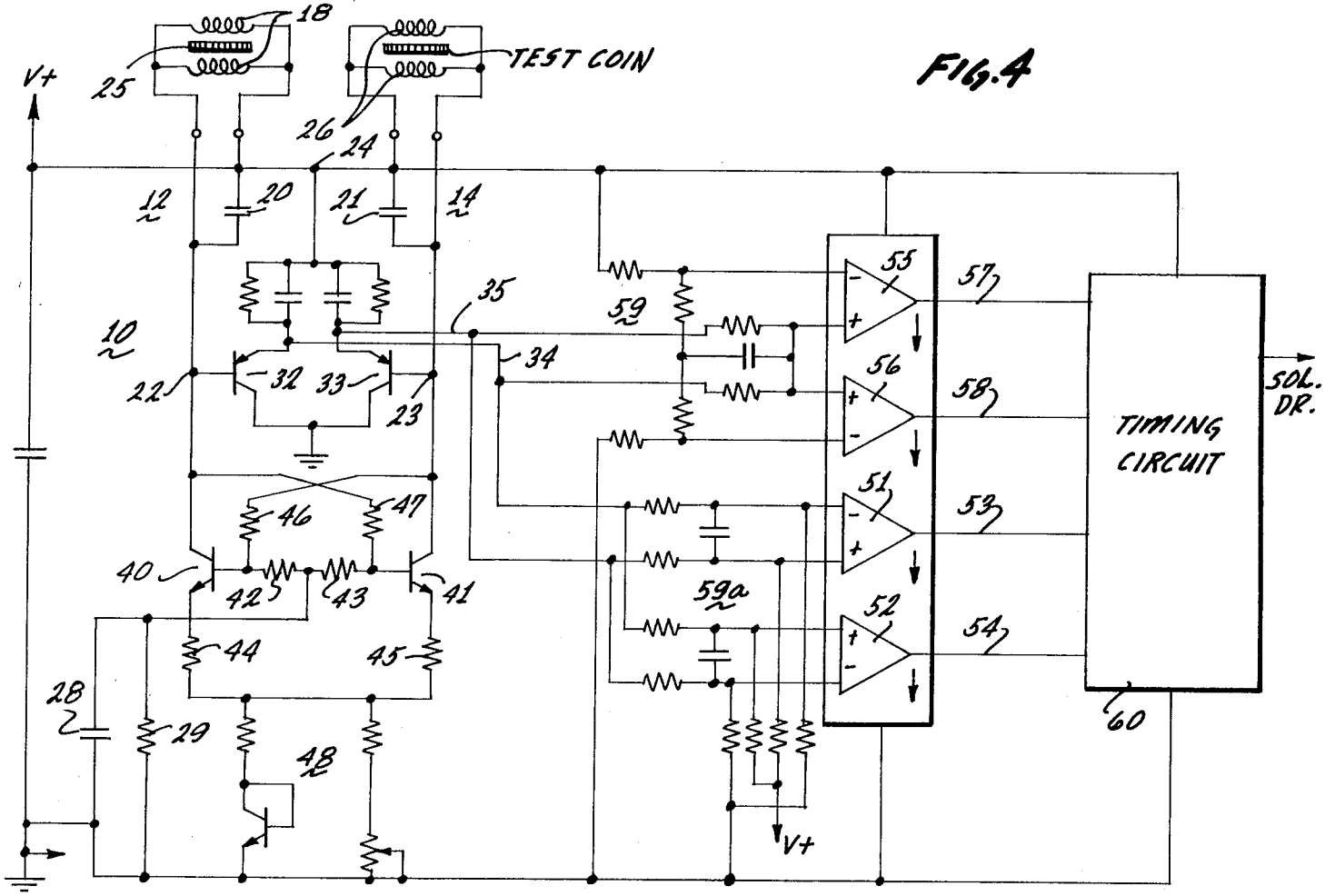
FIG. 4 is a detailed circuit diagram of the preferred embodiment of the invention showing a coin-testing circuit for practicing the preferred mode.

A first embodiment of the invention is seen in greater detail in the schematic circuit diagram of FIG. 4. As seen there, the oscillator drive circuit 16 includes a pair of transistors 40 and 41, connected in a common emitter configuration, and with each transistor having one of the tank circuits 12, 14 in its collector circuit. The biasing network includes emitter resistors 44 and 45, which connect the emitter of the respective transistors 40, 41 to ground through a common resistive current source 48. The base electrodes of the transistors 40, 41 are biased through network which includes resistors 42, 43 and 29, the latter being by-passed to ground by capacitor 28.

The two transistors 40, 41 are cross-coupled with symmetrical feedback networks, comprising a resistor 46 which feeds back the collector signal of transistor 41 to the base of the transistor 40 and feedback resistor 47, which feeds back a portion of the collector signal of transistor 40 to the base of transistor 41. The overall circuit is seen to be a symmetrical, dual feedback oscillator tuned to the interactive resonant frequency of the tank circuits 12 and 14.

As stated, tank circuit 12 is arbitrarily designated as a reference reactance, although it is understood that this designation between the two tank circuits may be reversed. The tank circuit 12 is tuned to a fixed particular frequency which is selected to be as nearly equal as possible to the resonant frequency of tank circuit 14 when a particular type of coin 25 is located adjacent to the sensing inductor 26 of the tank circuit 14. Identical physical construction mandates this equality. As was outlined above, the nodes 22 and 23 establish sense points for the oscillatory condition of the symmetrical dual feedback oscillator. There are a variety of ways available for ascertaining the oscillatory conditions in these nodes and in representation of the absence or presence of a proper coin in chute 27. Note that a less preferred embodiment would have the feedback resistors 46 and 47 connected to the emitters of transistors 41 and 42 in a noncross coupled fashion.

The circuit shown in FIG. 4 and to be described next illustrates what is deemed to be the best mode of practicing the invention. Two envelope detectors are respectively connected to the sense nodes 22 and 23 and respectively include two transistors 32 and 33. The two transistors 32 and 33 have commonly grounded collectors and RC-loaded emitter circuits to be connected to the voltage supply line 24. Output nodes 34 and 35 yield in fact the envelope of the oscillatory signals respectively arising on nodes 22 and 23, with minimal loading of tank circuits 12 and 14.

Figure 5:
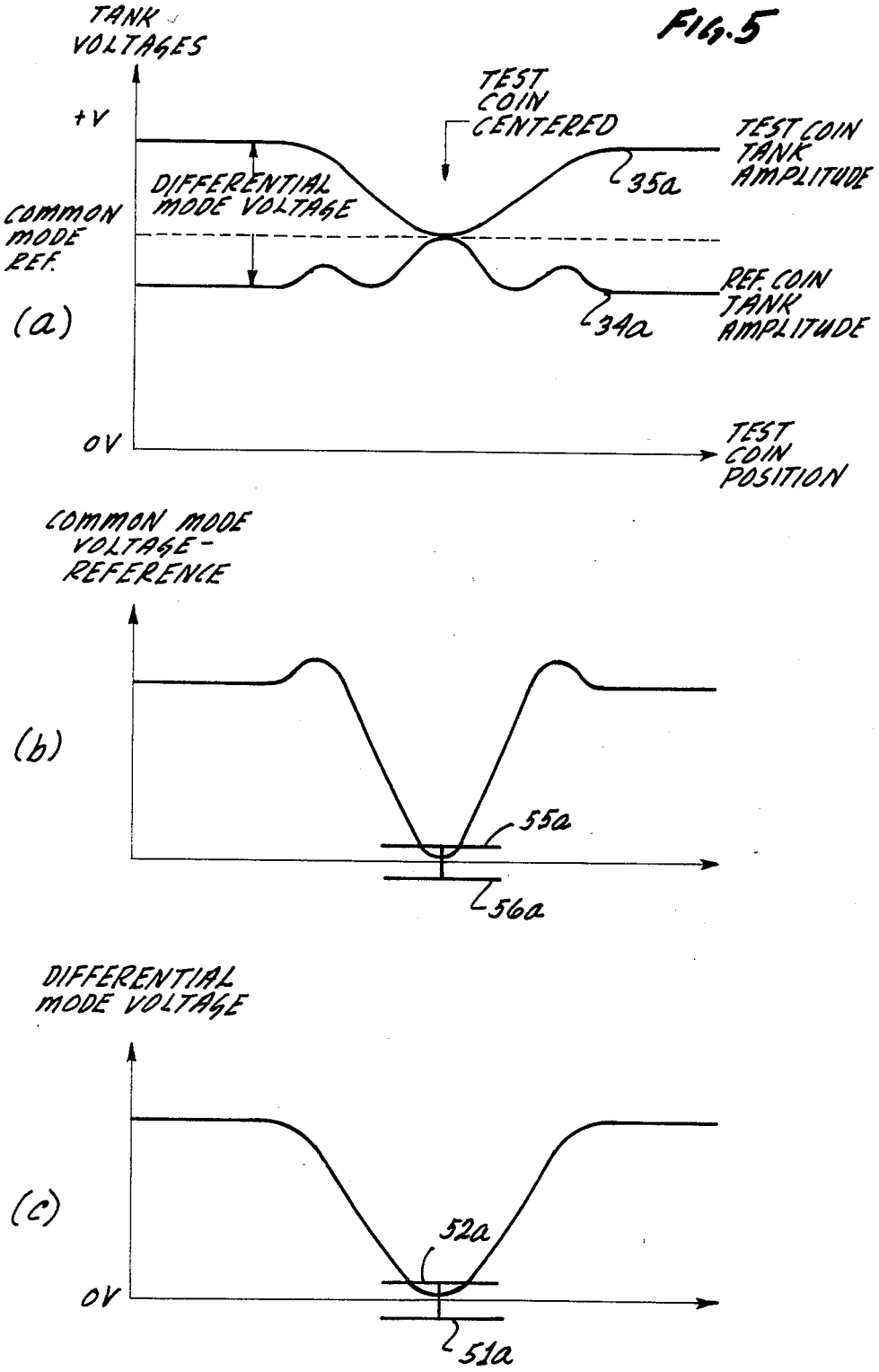
FIG. 5 shows several signal diagrams for explaining the operation of the circuit shown in FIG. 4.

FIG. 5, diagram a, illustrates the envelope excursion when a proper test coin passes through chute 27. The abscissa in this diagram can be interpreted to denote time under the assumption that the test coin passes through the chute and particularly through the split sensing coil 26 at a constant or near constant speed. Alternatively and without the assumption of a constant speed, the abcissa can be interpreted as a path extending, for example, along center line of the chute from the entrance and down the line towards the exit. The envelope signals denote and represent the maximum excursion voltage below V+ amplitude of the signal at nodes 22 and 23 depending upon the relative position of the test coin in the chute and in relation to the sensing coil 26. The velocity of the coin does not, for physically practical values, enter into the signal pattern. Due to the cross-coupling, oscillations in the reference circuit with tank 12 does not remain unaffected by the passage and presence of the test coin in the chute. Decisive is, however, that the two envelopes have equal value when the test coin has the same relative position to coils 26 which reference coin 25 has in relation to coils 18, provided of course the coil patterns and their dimensions are the same or are matched for this particular situation and provided further that the test coin is of the same type and exhibits the same characteristics and is in effect the same currency as the reference coin 25. Certain aspects here will be discussed later. It should be noted that this symmetrical, dual feedback oscillator easily produces high level signals which acquire no amplification or complex processing stages before the accept/reject discrimination.

The two sense nodes or lines 34 and 35 are respectively connected to the two inputs each of two comparators 51 and 52. The input circuits are suitably resistably biased by network **59*a* in order to yield a differential detection band 51*a* and 52*a* (FIG. 5*c*) to test envelopes established by the dual feedback oscillator and sensing circuits as described, particularly the output envelope detectors. The two comparators 55 and 56 establish together a differential mode detection circuit with a particular detection band in conjunction with network 59*a*. The differential mode voltage as such is to be understood to be defined by the difference between the signal levels in line 34 and 35, as depicted in FIG. 5*c*. That voltage per se is not directly established in a comparator circuit but is simply the potential difference between lines 34 and 35. Compacitors shown in networks 59 and 59*a*** are used only for noise immunity.

The circuit 51 detects whether or not the differential mode voltage remains above the threshold **52*a* which is normally the case. In fact, that portion of the circuit determines whether or not temporarily the envelope at line 34 actually exceeds the envelope voltage at line 35. Normally the voltage envelope at line 35 is at a higher potential than the envelope voltage in line 34. The circuit 52 determines whether or not the differential mode voltage drops below threshold level 52*a*. The two levels 51*a*, 52*a* define the detection band. In the case a proper coin passes through the chute and the sense coils 26, the differential mode peak excursion will extend into that band but that condition persists only for the period of time it takes for the coin to pass the coils 26. It can thus be seen that a proper coin requires response of comparator 52 but no response, i.e., no change in output conditions by the comparator 51. These conditions are established on the output lines 53 and 54 and can be processed logically because the output of these comparators can be treated as logic signals. It is envisioned here that the timing circuits 60** to which these two signals are applied operate on a digital basis.

The circuit includes two further comparators 55 and 56. The lines 34 and 35 are connected to inputs of these identical comparators having the same sign while the respective negative inputs are connected to a resistive network 59, which establishes a particular bias. The bias is spread symmetrically about a level which serves as a common mode reference and can be deemed to be the average of the two individual bias levels as applied to the negative inputs of the circuits 55 and 56. The circuit therefore is provided to determine whether or not the common mode, i.e., algebraically the average of the signals in line 34 and 35 reaches the common mode reference established by network 59. The detection band spread is a result of a difference in the two biasing levels and establishes in a defined manner the size of the common mode voltage detection band. The two levels in FIG. **5*b* and denoted 55*a* and 56*a* respectively are the threshold levels of the two comparators 55 and 56 and the combination of output signals in lines 57 and 58 determines whether or not the common mode signal is in that common mode detection band. In the case of a proper coin passing through chute 27, that common mode signal should reach the detection band but should not exceed it, but temporary persistence is again determined by the timing circuit 60**.

It should mentioned and now explained that for the purposes of detecting a coin and discriminating a proper coin against other coins, particularly foreign coins of similar dimension or against slugs, each one of these detection modes would suffice. In other words, the coin accept/reject circuit will operate with a common mode detection and detection band as described, and in the alternative it will operate with a differential mode detection and detection band. In fact then, the two detection modes provided together appear to exhibit a certain degree of redundancy. For reasons of safety generally, redundancy is often advisable and it should be mentioned at this point that today it becomes increasingly common to utilize packaged integrated circuit devices whereby the particular commercially available chip includes a fixed number of logic gates or in this case a fixed number such as four comparators. Thus strictly from an economical point of view one would use this four comparator I.C. even if only two were used either for common mode or for differential mode detection. Therefore from an economically point of view, the supplemental redundancy as provided here can be established through the simple addition of a few input circuits for these comparators. In other words, redundancy can be made available with very little increase in cost. But aside from these commercial aspects, the combined common mode and differential mode detection contributes much more than just pure redundancy.

Tests and experience has shown that the response of the differential mode circuit to an improper coin or slug is based predominately though not exclusively on the difference such slug or improper coin establishes as far as the inductance within the tank circuit is concerned as compared with the inductance reference coin 25 produces in the reference tank circuit. The common mode on the other hand provides a deviation from the common mode reference in the case of a slug on an improper coin based predominately though not exclusively on differences in resistivity as between the slug and a proper coin as represented by the reference coin. To put it differently, common mode discrimination is based more on detecting the lossiness of the coin passing through as compared with the reference coin, and differential mode discrimination is based more on detecting the effective inductance of the test coin and coil versus the reference coin.

These differences in detection principles and underlying physical phenomena involved are quite important because it is conceivable that through trial and error a person may be able to machine or otherwise work a slug which passes the differential mode test. Extensive tests conducted have revealed however that such a slug positively exhibits a different common mode characteristic. The reverse is also true; a slug machined to match the lossiness of the reference coin invariably exhibits a different inductance. Thus a slug machined to pass one test will fail the other. I verily believe that in order to pass both tests, a slug has to be made in such a manner that it must be regarded to be a counterfeit. Of course, no circuit can guard against precisely made counterfeit coins. But it can readily be seen that the circuit as described is considerably more sensitive for purposes of discriminating against foreign coins or slugs which are being used. Therefore, the precision and expense required to construct a counterfeit coin becomes an uneconomic enterprise. The circuit is also sensitive against designed and willfully planned attempts to "outwit" the detection apparatus just falling short of being able to discriminate against true counterfeits, which are constructed with special alloys or clad assemblys which match the real coin. Also, this dual test feature would cause the determination of a workable counterfeit to be a potentially endless tedious task.

In this regard it is apparent that the best mode of the invention is practiced under utilization of a reference coin identical with the type of coin to be exclusively accepted by the circuit. One can, however, use a different coin or one can use a different inductance modifier and still practice the invention. In a more simplified form of practising the invention, particularly in cases in which attempts to make slugs tending to "beat the system" are not to be expected, it may even suffice to replace the common mode detection by referencing, for example, the signal in line 35 against an amplitude reference. The signal excursion depicted in FIG. 5*b* is quite similar to the signal excursion 35*a*. The sensitivity of such a detection is somewhat reduced but is within the realm of the possibilities involving a system that is somewhat less sensitive and simplified.

After having described salient aspects of the detection process to determine absence or presence of an accept or reject situation, reference should be made briefly to the function of the timing circuit 60. That function does not require elaboration, except one can see that in either one of the situations depicted in FIGS. 5*b* and 5*c*, a reject situation is present if either the common mode voltage or the differential mode voltage or both have a peak excursion below both thresholds. In these situations, each coin passage produces two very brief and rapidly occurring accept situations as far as the signal relations on lines 53 and 54 is concerned as well as the signal relations on lines 57 and 58. This of course occurs whenever the signal excursion traverses the respective detection bands on a downswing first and an upswing again shortly thereafter. Tests show that the energy provided to the solinoid in this circumstance is far below that required for actuation. Additional digital time characteristic tests can be done to reject what is called "stringing" in the trade, but these are not the subject of this patent.

Alternatively, the operation may be carried out digitally in that the recurrence of an accept condition within a very short timespan is also interpreted as a reject situation. In other words the timing circuit 60 detects as an accept situation the occurence an accept condition in the respective detection band without a repetition of that particular condition until a certain time has elapsed equivalent, for example, to the passage of a coin through the chute. This would be useful for the analog sum test alternative described later.

Figure 6:
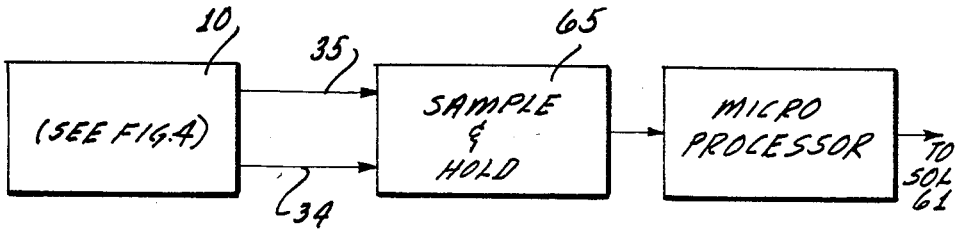
FIG. 6 is a schematic diagram of a modified detection circuit.

FIG. 6 illustrates in the left hand portion the same kind of a symmetric, dual feedback oscillator as described. The envelope signals in lines 34 and 35, however, are fed to a dual sample circuit 65 which samples the envelope signal level at a suitable rate of sampling. The rate should be longer than the oscillating frequency the oscillator. The sampling rate must be matched to the change in amplitude per unit time on the basis of diagrams such as FIG. 5. These sample signals may be digitized and fed through a microprocessor 66 which performs the described functions as far as common mode and differential mode testing is concerned. In other words, the microprocessor forms digitally the sum of the signals and the difference of the signals as sampled at the outputs 34 and 35 and compares them with references suitably stored and pre-programmed in the microprocessor to calculate, accept and reject conditions as explained on the basis of the analog signals as per FIG. 5.

Figure 7:
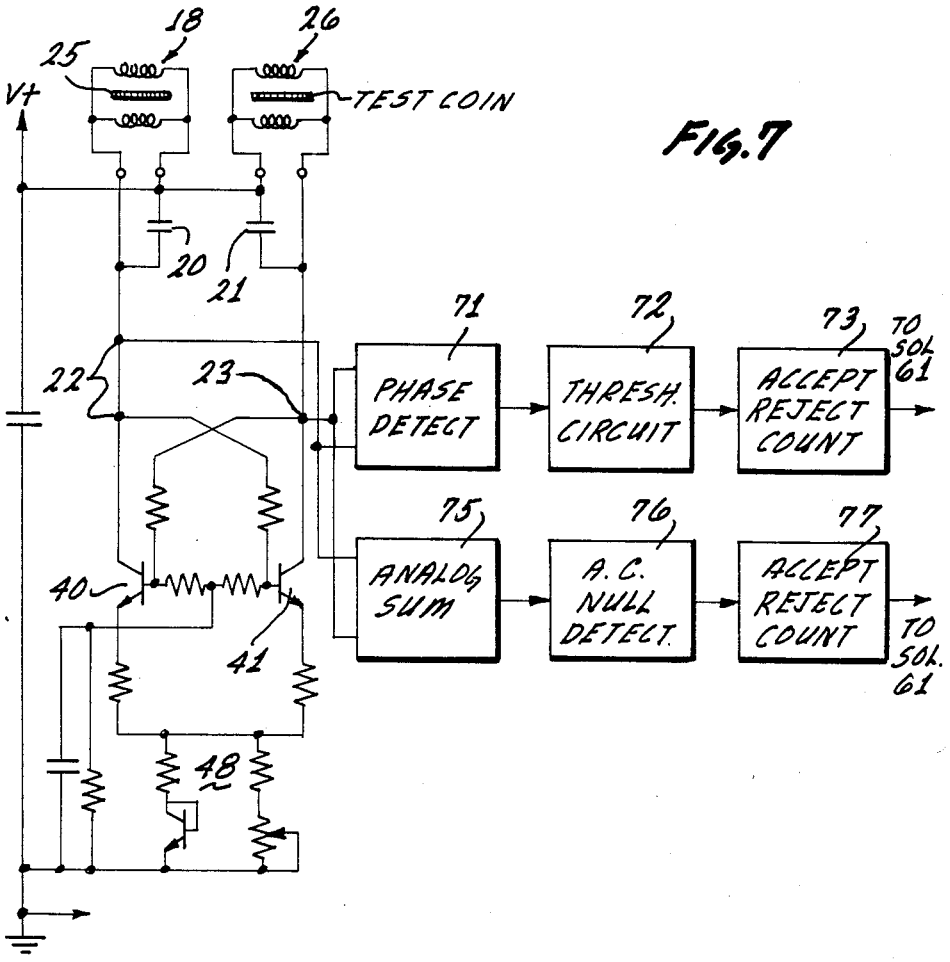
FIG. 7 is another example for practicing the invention.

FIG. 7 is another modification; a somewhat more costly version and for reasons of unnecessary complexity of lesser degree of preference. The circuit is illustrated in FIG. 7 has many of the components explained and described above, particularly, it has the same dual feedback oscillator configuration but instead of envelope detection, the oscillating signal in nodes 22 and 23 are used directly. Circuit 71 is a phase detector which detects the phase between the nodes 22 and 23. An acceptance condition is present only when the signals at the nodes 22 and 23 are precisely 180° out of phase and of course the signals do have equal frequency. That condition can be monitored by means of numerous well-known phase detection techniques to drive circuit 72. A special timing circuit 73 determines whether or not this 180° out-of-phase condition occurs at all, not at all, or twice within a short period of time. It must occur only once to establish an accept condition.

An alternative or additional detection operation is provided through circuit 75 which establishes the analog sum. It will be recalled from the discussion above that the envelope signals are of equal magnitude in the case of a true accept condition. This means that the instaneous amplitude of the signals at the nodes 22 and 23 are identical. Since an accept situation is present only in case of an identical 180° out-of-phase situation, right at the time when the amplitudes are equal, the analog sum of the two signals at the nodes 22 and 23 should be zero. Therefore, an A.C. null or zero detector 76 monitors the output of the analog sum circuit provided by circuit 75 and responds if in fact an A.C. null is present. A circuit 77 establishes whether or not this null condition occurs not at all, just once or twice. In order to define and establish an accept situation, the null detection must occur only once during a detect and inspection cycle defined by the passage of a single coin.

It can readily be seen that there is a certain analogy to the preferred embodiment in the sense that there is the phase detection which is responsive primarily to similarity and dissimilarity in the inductive parameters of the test coin as compared with the reference coin within the sensing circuit, while the circuit 75 is responsive primarily to the similarity or lack of it of the lossiness and inductive parameters of the two coins. This of course in principle permits for example the pairing of the phase detector 71 with the common mode detector in FIG. 4 or the pairing of the differential mode detectors with the analog sum detector 75. These possibilities are however mentioned here only for purposes of completion and in order to demonstrate the versatility of the invented design and principle involved. The common mode and differential mode detection explained with reference to FIG. 4 are clearly deemed to be preferred since the overall combination of sensitivity and economic simplicity resulting from such a configuration exceeds the others.

In conjunction with FIG. 6, it can readily be seen that the two nodes 22 and 23 can be digitally sampled. This means that the phase detect circuit 71 may be replaced by a digital unit performing through operation of a microprocessor the phase detection test, using for example such well known techniques as digital high frequency counting, sequential logic lead lag detection and others. In principle, the analog sum formation in circuit 75 could also be carried out digitially. This, however, is clearly not preferred though possible in principle, because the formation of an analog sum is a comparatively simple task. On the other hand, the A.C. null detection as per circuit 76 may well be carried out through sampling the sum signal, digitizing it and detecting digitally a below threshold number equivalent to a "null".

Another aspect to be considered is that in a given circuit configuration and again particular reference is made to FIG. 4, passage of a correct and proper coin does not only result in excursions of the common mode and the differential mode signals each having an extremity within their respective adjusted detection band. Rather the amplitude envelope configuration as a whole and the relationship between these signals for example such as the maxima and the minimum of the common mode signal and differential mode signal or the depth of the respective excursions as compared with steady state preceding and succeeding the minimum as well as the magnitude of the envelope signal in particular positions of the coin before and after the passage through a position which produces the extremity in the excursion, are well defined values. Additional tests such as amplitude tests can be provided in the sense that a correct coin when passing through the chute must produce a particular amplitude pattern in order to pass the test. It should be mentioned that amplitude testing, either the actual amplitudes or the envelope amplitude at various points along the chute, is preferably carried out digitally through digital processing any of the signals, as depicted in FIG. 5.

Flat printed circuit type spiral coils in a symmetrical disposition of placement as described has been found to obtain the desired sensitivity. In principal, other types of coil shapes such as parallel wire bound coils, circumferential wire bound coils, elliptical, square, rectangular shaped or other kind of coils can be used to operate the principle of the invention. Additionally, the principle of this invention may be operated with the coils placed in other than the preferred orientation shown in FIG. 1.

The symmetrical, dual feedback oscillator circuit as described uses regular N-P-N transistors. This was found to be practical and of advantage. Other semiconductor elements, such as F-E-T and other type of elements could be used. Looking particularly at FIG. 4 it can readily be seen that the oscillator and sensing portion, with the exception of the sensing coils, can be combined and packaged with the comparator circuit and conceivably a common and therefore to some extent simplified I.C. circuit could be devised. This, however, is a matter of economics and depends on the number of units manufactured and does not relate to the principles of the invention.

The invention is amenable to multiple coin testing. Of course, different units can be designed to test different coins wherein the circuits as such are similar, just the reference coins differ. However, as was mentioned above, the utilization of a reference coin is an optimum as far as sensitivity is concerned. It establishes particular reactance conditions throughout the cross-coupled circuit and oscillators. If a particular reference coin is used and a different coin passes through, it establishes for example a different common mode and a different differential mode configuration. The particular amplitude relationships and conditions are different when a different coin passes through the chute, but these conditions are well defined. Detection bands can be set up to respond particularly to the signal excursion levels as then exist at the time of passage of such coins. In other words, the definition of the correct coin, broadly speaking, depends upon the placement of a detection band in relation to the signal excursion patterns as they occur for different coins. Therefore, one can detect different coins in different detection bands using but a single reference reactance. Preferably, in such a situation, one will use the microprocessor configuration rather than duplicate analog circuitry.

The invention is not limited to the embodiments described above; but all changes and modifications thereof, not constituting departures from the spirit and scope of the invention, are intended to be included.

I claim:

1. A coin testing device and apparatus comprising a symmetric, dual feedback oscillator including two tank circuits, one of the tank circuits including a reference reactance, the other of the tank circuits including sensing reactance, said dual feedback oscillator forming a symmetrical, substantially balanced circuit; and comparator means connected for deriving separate outputs from symmetrical points of the oscillator and providing a signal indicative of a pre-determined relationship between the oscillatory signals in said reference and said sensing reactances in the presence of a particular type of coin adjacent to said sensing reactance.

2. The device as in claim 1, the comparator means including, as an input circuit, envelope detection circuits respectively connected to said points and providing respective two envelope outputs, the relation of said envelope output leading to said indicative signal.

3. The device as in claim 2, the comparator means including differential mode detect circuits forming differential mode indications as between said envelope signals, further including an accept band defining means providing said signal when said differential mode indication falls within said detection band.

4. The device as in claim 2, said comparator means including common mode detection means connected to receive the two envelope signals and providing said signal indication to establish whether or not the common mode signal falls within a particular detection band.

5. The coin testing device as in claim 2, the comparator means including a differential mode amplifier circuits forming differential mode indications as between said envelope signals, further including an accept band defining means providing said signal when said differential mode indication falls within said detection band; further including common mode detection means connected to receive the two envelope signals and providing said signal indication to establish whether or not the common mode signal falls within a particular detection band so as to obtain both, common mode and differential mode operation.

6. The coin testing device as in claim 1, the comparator means including a phase detector connected to establish the phase relationship between said separate outputs, a particular phase establishing the presence of a particular type of coin adjacent to said sensing reactance.

7. A coin testing device as in claim 1, said comparator means including algebraic signal summing means connected to said outputs and being responsive to a particular amplitude in representation of a presence of a particular type of coin adjacent to said sensing reactance.

8. A device as in claim 1 wherein said reference reactants and said sensing reactants each comprise an inductance, the respective inductances being constructed substantially identical to each other, the referenced reactants further including a reference coin position adjacent to said referenced reactants.

9. A device as in claim 8 wherein said sensing reactants and reference reactants each comprise two or more coaxially aligned coils etched on at least one pair of printed circuit boards mounted in spaced parallel relationship, the referenced sensing coils being oriented edgewise with respect to each other to thereby minimize mutual coupling.

10. A testing device as in claim 1, said comparator means including a circuit means for establishing a narrow detection band, a predetermined relationship between said separate outputs require signal representation within said bands in representation of a presence of a particular type of coin adjacent to said sensing reactants.

11. A coin testing device as in claim 1, said comparator means including means for establishing a plurality of different detection bands respectively for testing different type of coins when adjacent to said sensing reactants, the comparator means further including signal formation means causing the formed signal to fall in one said detection bands when the respective coin is one of the particular types.

12. A coin testing device as in claim 2, the comparator means including sampling means connected to receive said envelope outputs and sampling the same, further including microprocessor means for processing the sampled signals in order to provide said indicative signal.

13. The coin testing device as in claim 2, the comparator means including a differential mode amplifier circuits forming differential mode indications as between said envelope signals, further including an accept band defining means providing said signal when said differential mode indication falls within said detection band; and means including algebraic singal summing means connected to said outputs and being responsive to a particular amplitude in representation of a presennce of a particular type of coin adjacent to said sensing reactance.

14. The device as in claim 2, the comparator means including including common mode detection means connected to receive the two envelope signals and providing said signal indication to establish whether or not the common mode signal falls within a particular detection band;

a phase detector connected to establish the phase relationship between said separate outputs, a particular phase establishing the presence of a particular type of coin adjacent to said sensing reactance.

15. The device as in claim 1, said comparator means including a a phase detector connected to establish the phase relationship between said separate outputs, a particular phase establishing the presence of a particular type of coin adjacent to said sensing reactance.

means including algebraic singal summing means connected to said outputs and being responsive to a particular amplitude in representation of a presence of a particular type of coin adjacent to said sensing reactance.

16. The device of claim 1, wherein each said tank circuit comprises an inductance and a capacitance in parallel with said inductance.

17. The device of claim 10, said inductances being constructed substantially identically to each other, and further comprising a reference coin positioned adjacent to said reference reactance.

18. The device of claim 17 wherein said sensing reactances each comprise two or more coaaxially aligned coils etched on at least one pair of printed circuit boards mounted in spaced parallel relationship, said reference and said sensing coils being oriented edgewise with respect to each other to thereby minimize mutual coupling.

19. A coin testing device as in claim 2, the comparator means including sampling means for sampling said envelope outputs during passage of a coin past said sensing reactance, further including means for detecting absence or presence of a particular amplitude pattern.

20. A coin testing device as in claim 2 the comparator means including differential mode detect circuits forming a differential mode indication as between said envelope signals, and means for determining an amplitude pattern of the differential mode indication during passage of a coin past the sensing reactant, for providing said indicative signal.

21. A coin testing device as in claim 2, said comparator means including common mode detection means connected to receive the two envelope signals and providing common mode signal, and means for determining an amplitude pattern of the common mode signal during passage of a coin past the sensing reactant, for providing said indication signal.

22. A coin testing device comprising:

oscillator means including symmetrical, dual feedback oscillator having a reference reactance and a sensing reactance; and comparator means connected for deriving an output indicative of a predetermined relationship between the signals in said reference and said sensing reactances in the presence of a particular type of coin adjacent to said sensing reactance.

23. The device of claim 22 wherein said comparator means are connected for comparing the amplitude of the signals in said reference and said sensing reactances.

24. The device of claim 22 wherein said comparator means are conneced for comparing the phase relationship of the signal in said reference and said sensing reactances.

25. The device of claim 22 wherein said reference reactance and said sensing reactance each comprises an inductance, said inductances being constructed substantially identically to each other, and further comprising a reference coin positioned adjacent to said reference reactance.

26. The device of claim 25 wherein said sensing reactances each comprise two or more coaxially aligned coils etched on at least one pair of printed circuit boards mounted in spaced parallel relationship, said reference and said sensing coils being oriented edgewise with respect to each other to thereby minimize mutual coupling.

27. The device of claim 22 wherein said comparator means comprise two inputs, each input being connected to receive one of said signals in said reference and said sensing reactances further comprising amplitude detector means for deriving an envelope voltage from each of said signals in said reference and sensing reactances, each of said envelope voltages being fed to one of said comparator inputs.

28. The device of claim 27 further comprising differential amplifier means deriving a differential output related to the difference between the envelope signals.

29. The device of claim 28 wherein said comparator means further comprises threshold circuit means for deriving coin accept output where the amplitude of said difference output falls within a predetermined detection band.

30. The device as in claim 27, said comparator means including common mode detection means connected to receive the two envelope voltages, each of the envelope voltages being fed to one of the comparator inputs.

31. A coin testing device and apparatus comprising a symmetric, dual feedback oscillator each including a tank circuit, one of the tank circuits including a reference reactance, the other of the tank circuits including a sensing reactance, said dual feedback oscillator forming a symmetrical, substantially balanced circuit; and comparator means connected for deriving an oscillator voltage from at least one of the oscillator nodes and from a reference source, and providing a signal indicative of a pre-determined relationship between the oscillatory signal and said reference in the presence of a particular type of coin adjacent to said sensing reactance.

32. The device as in claim 31 the reference source being a symmetric point within the oscillator.

* * * * *